United States Patent [19]

Taguchi et al.

[11] Patent Number: 5,000,667

[45] Date of Patent: Mar. 19, 1991

[54] MOVABLE SLANTING PLATE TYPE COMPRESSOR

[75] Inventors: Tatsuhisa Taguchi, Katano; Yoshikazu Abe, Neyagawa, both of Japan

[73] Assignee: Matsushita Electric Industrial Co., Ltd., Osaka, Japan

[21] Appl. No.: 361,869

[22] Filed: Jun. 6, 1989

[30] Foreign Application Priority Data

Jul. 6, 1988 [JP] Japan ..... 63-140005

[51] Int. Cl.[5] ..... F04B 1/26; F01B 3/02

[52] U.S. Cl. ..... 417/222; 417/270; 91/505; 92/12.2

[58] Field of Search ..... 417/222, 222.5, 270; 91/499, 504, 505, 506; 92/12.2; 123/43 A, 43 AA

[56] References Cited

U.S. PATENT DOCUMENTS

| | | | |
|---|---|---|---|
| 1,250,709 | 12/1917 | Tanner | 123/43 A |
| 1,880,224 | 3/1930 | Wilsey | 123/43 A |
| 3,818,803 | 6/1974 | Scott et al. | 91/499 |
| 3,970,055 | 7/1976 | Long | 123/43 A |
| 4,690,036 | 9/1987 | Kosaka et al. | 417/222 |

FOREIGN PATENT DOCUMENTS

| | | | |
|---|---|---|---|
| 713659 | 3/1931 | France | 91/499 |
| 58-158382 | 9/1983 | Japan . | |
| 230572 | 11/1985 | Japan | 91/499 |
| 62-147055 | 7/1987 | Japan . | |

*Primary Examiner*—Leonard E. Smith
*Assistant Examiner*—John A. Savio, III
*Attorney, Agent, or Firm*—Wenderoth, Lind & Ponack

[57] ABSTRACT

A compressor of a movable slanting plate type which includes a shaft to be rotated by receiving an external driving force, a rotor having a plurality of cylinder chambers disposed in a parallel relation with the shaft so as to be rotated together with the shaft, a plurality of pistons which revolve while reciprocating within each of the cylinder chambers, a plurality of rods each connected at its one end, to each of the pistons, and having a ball joint at its other end, a plurality of holder shoes each connected to the rod through the ball joint for free directivity, a movable slanting plate revolving supporting said holder shoes, and capable of changing its inclination angle to one direction with respect in the shaft, a valve plate provided with a plurality of suction ports and discharge ports communicated with the cylinder chambers of the rotor, and a guide plate fixed to the shaft or the rotor and formed with guide bores for slidably guiding the plurality of the rods in the axial direction.

5 Claims, 6 Drawing Sheets

MOVABLE SLANTING PLATE TYPE COMPRESSOR

BACKGROUND OF THE INVENTION

The present invention generally relates to a compressor and more particularly, to a compressor of a movable slanting plate type to be used, for example, in a car air-conditioner for air-conditioning a motor vehicle or the like.

Recently, in the field of air-conditioning apparatuses for motor vehicles, there have been made various developments for achieving quick effects for cooling, heating, defrosting or the like, improvements on comfortable temperature and humidity control characteristics, reduction of burden on a motor vehicle engine, or reduction of fuel cost, etc. In compressors, as one means for such developments, performance control techniques therefor have been studied over a long period, some of which are now put into actual applications. One of such improvements relates to a wobble slanting plate type compressor disclosed, for example, in Japanese Patent Laid-Open Publication Tokkaisho No. 58-158382 in which, by arranging an inclination angle of a slanting plate to be variable through internal pressure control for a crankcase and utilization of a centrifugal force of a wobble plate, the stroke of a piston is altered to make a physical displacement or exhaust amount variable.

FIGS. 9 and 10 show a general construction of a conventional wobble slanting plate type compressor as referred to above.

In FIG. 9, the known compressor includes a cylinder block 1, a rear case 2 and a crankcase 3 tightly closing opposite end portions of said cylinder block 1, and a driving shaft 4 supported by radial roller bearings 5 and 6, and further held in an axial direction by thrust roller bearings 7 and 8 as shown. The cylinder block 1 has a plurality of cylinders 9 axially extending therethrough, and in each of the cylinders 9, a piston 10 is slidably mounted for reciprocating movement and connected for free directivity, a non-rotating wobble slanting plate 12 by a rod 11 through a ball joint portion 13. The wobble slanting plate 12 is mounted on a rotary driving plate 14 through a thrust roller bearing 15, and is axially retained by a thrust washer 16 and a retainer ring 17.

As is seen in FIG. 10, the rotary driving plate 14 is rotatably connected with a sleeve 18 slidably mounted on the driving shaft 4 by a pair of pivotal axis pins 19, with a common axis of said pins 19 intersecting at right angles with the axis of the driving shaft 4 so as to allow said rotary driving plate 14 and wobble slanting plate 12 to be inclined. The driving shaft 4 has a protrusion 22 extending through a longitudinal direction slot 20 of the sleeve 18, and provided with a guide slot 21 for guiding the inclination of the rotary driving plate 14. This protrusion 22 engages a lug 23 integrally formed with the rotary driving plate 14, and retained with respect to said lug 23 by a lateral pin 24 slidably guided within the guide slot 21. Although the wobble slanting plate 12 may be inclined together with the rotary driving plate 14, it is prevented from being rotated integrally with the rotary driving plate 14 by a guide pin 27 slidably mounted with a ball guide 26 which is held through a guide shoe 25 of a semi-circular cylindrical shape slidably mounted on the wobble slanting plate 12. A valve plate 28 provided with a suction port 29 and an exhaust port 30 has a suction valve disc 31 and a discharge valve disc 32 at its opposite sides, and is fixed between the cylinder block 1 and the rear case 2. There are also provided a discharge valve presser plate 33, a suction chamber 34, a discharge chamber 35, a crank chamber 36, a cylinder chamber 37 for the piston 10 at the side of the valve plate 28, a return spring 38 mounted on the driving shaft 4, and a control valve 39 provided in the rear case 2 for controlling the internal pressure in the crank chamber 36.

Functioning of the conventional wobble slanting plate is described hereinafter.

Upon driving of the driving shaft 4 from outside, the rotary driving plate 14 engaged with the protrusion 22 is rotated at an inclination angle, and based on the wobble motion of the non-rotating wobble slanting plate 12 through the thrust roller bearing 15, the pistons 10 each connected to the wobble slanting plate 12 by the rods 11 through the free-directivity ball joints 13, effect the reciprocating movement within the cylinders 9 in the axial direction, whereby the cooling medium gas flows into the cylinder chamber 37 through the suction port 29 in a suction stroke in which the piston 10 is displaced from an upper dead center to a lower dead center, and flows out from the cylinder chamber 37 through the exhaust port 30 in the compression and discharge strokes in which said piston 10 is displaced from the lower dead center to the upper dead center.

It is to be noted here that the performance control is intended to alter the volume of the cylinder chamber 37, i.e. displacement or exhaust amount thereof non-stepwisely by varying the stroke of the piston 10 through variation of the inclination angle of the wobble slanting plate 12. The inclination angle of the wobble slanting valve 39 for controlling the internal pressure of the crank chamber 36 at the back of the piston 10 with respect to the suction pressure, and balancing of force at the piston in which an exerting force based on the centrifugal force of the rotary driving plate 14 is produced on the piston 10. Accordingly, when a thermal load is high, the displacement i.e. exhaust amount is made maximum by rendering the inclination angle of the wobble slanting plate 12 largest through elimination of a pressure difference between the suction pressure and the internal pressure of the crank chamber 36. Meanwhile, when the thermal load is low, and the suction pressure becomes lower than that at the suction pressure control point set on the control valve 39, the control valve functions to raise the internal pressure in the crank chamber 36 and to reduce the inclination angle of the wobble swashing plate 12, and consequently, the stroke for the piston 10 is reduced for the reduction of the displacement or exhaust amount.

It should also be noted that the positions of the slanting plate 12 and the rotary driving plate 14 are determined by the pair of pivotal axis pins 19 connected to the sleeve 18, and the lateral pin 24 sliding within the guide slot 21 formed in the protrusion 22 of the driving shaft 4, thereby giving a constant upper dead center position to the piston 10.

The performance control of the wobble slanting plate type compressor as described above is of the system for varying the physical displacement in principle, and shows a comparatively superior performance control efficiency (At the period of 50% performance, the result coefficient ratio is about 90% with respect to the period of 100% performance).

However, the conventional wobble slanting plate type compressor has various problems as described hereinafter.

Firstly, the compression principle of the compressor which forms the basis of the arrangement is of the reciprocating system anyhow, which is low in volumetric efficiency (i.e. substantially effective discharge amount with respect to the displacement or exhaust amount). The main cause of such disadvantages is attributable to the compressed residual cooling medium gas volume at the upper portion of the piston and the resistance of the suction valve. This defect is one of the bottlenecks for the reduction in size and weight of a compressor.

Secondly, with respect to the internal pressure control for the crankcase in the control of the inclination angle for the wobble slanting plate, fine pressure control (0.3–0.5 kg/cm$^2$) is required as well as the pressure control for a large space over one liter, thus presenting conditions disadvantageous to achieving sufficient response characteristics and control stability.

Thirdly, the fundamental construction of the compressor is of a system which has a large unbalanced physical load resulting from the wobble motion of the wobble swashing plate, and which is also inferior to the rotary type compressor in the noises arising from presence of the suction valve. Although the above disadvantages may be clearly alleviated during the performance control period as compared with compressors without such performance control function, vibrations and noises are still large under the operating conditions in which 100% performance is to be continued to the last.

Fourthly, with respect to the constructions related to the performance control function, due to presence of many sliding portions, there are some problems in the reliability and durability of members as well as in the lubricating characteristic.

In addition to the disadvantages as referred to above, there are many more problems to be solved such as matching characteristics to motor vehicles, costwise factors arising from the large number of parts, etc.

On the other hand, in a movable slanting plate compressor of the cylinder block rotating type having no suction valve, and disclosed, for example, in Japanese Patent Laid-Open Publication Tokkaisho No. 62-147055, there is a problem in the sealing between the cylinder block and the valve plate, with a large reduction of the volumetric efficiency during low speed rotation. Moreover, the conventional compressor referred to above is very complicated in the driving system for pistons, rods and holder plate, and also in the positioning mechanism, thus not being suitable for actual applications.

SUMMARY OF THE INVENTION

Accordingly, an essential object of the present invention is to provide a movable slanting plate type compressor which has a high volumetric efficiency, and is capable of effecting performance control with superior response characteristics.

Another object of the present invention is to provide a movable slanting plate type compressor of the above described type, which is compact in size, and low in noises.

In accomplishing these and other objects, according to one aspect of the present invention, as rotating means for the pistons and rods, a guide plate having guide bores each coaxially formed with respective cylinder bores is connected to a shaft or rotor so as to be rotated, with the rods being passed through said guide bores.

In another aspect of the present invention, for improving response characteristics during performance control, the end face of the rotor at the side opposite to a valve plate is closed by a separate member (the guide plate), while spaces at the back of pistons for a plurality of cylinder chambers are communicated, thereby to form a narrow pressure control space separated from the crankcase.

In a further aspect of the present invention, the movable slanting plate which does not rotate together with the shaft, but may be changed in the inclination angle only in one direction, is arranged to be guided, at its one end, by a positioning pin provided on a front cover of a compressor shell through an arcuate elongated opening formed in said slanting plate, and also guided by pins fixed to said slanting plate and adapted to slide in guide grooves in a boss portion which extends towards the rotor side from said front cover and in which said shaft rotates, with the inner wall at a central portion of said slanting plate being arranged to be guided by an outer wall of said boss portion.

In a still further aspect of the present invention, the suction/exhaust port provided for each cylinder chamber of the rotor is opened at the rotor end face with a diameter smaller than that of a cylinder bore, while at a head portion of the piston reciprocating within each of the cylinder chambers, a convex portion capable of entering said suction/exhaust port is formed.

In another aspect of the present invention, a plurality of the holder shoes are each arranged to be restricted in position by both sides being supported in an axial direction, on the movable slanting plate variable in its inclination angle within an angle range at least corresponding to a suction stroke for one revolution.

In still another aspect of the present invention, a positioning pin is provided on the front cover for positioning of the inclination angle of the movable slanting plate, and an arcuate elongated opening formed in the movable slanting plate at the lower portion of a crank chamber in the compressor shell.

In still further aspect of the present invention, the positioning pin is provided on the front cover for positioning of the inclination angle of the movable slanting plate to guide said arcuate elongated opening through face contact.

In another aspect of the present invention, the end face of said rotor at the side of said valve plate is rotated through a very small clearance with respect to said valve plate at a sealing portion of said suction/exhaust port, with a comparatively large clearance being provided at portions other than said sealing portion, and with part of discharged cooling medium gas being arranged to be introduced into an inner side beyond the sealing portion.

In a further aspect of the present invention, at the sealing portion which is the very small clearance at a peripheral portion of the suction/exhaust port provided in the end face at the valve plate side of the rotor rotating though the clearance with respect to said valve plate, a sealing member is provided at an outer peripheral side of a suction port and a discharge port of said valve plate.

In a still further aspect of the present invention, the lower portion of the crank chamber and the inner wall of the boss portion extending outwardly from said front cover are communicated with each other, with a pump portion being formed at the inner wall of said boss portion and at the shaft portion rotating in said inner wall, so as to supply a lubricating oil to bearing portions of the shaft, the rotor and the guide plate which rotate as one unit.

In another aspect of the present invention, passages for communicating a suction chamber formed in a rear cover for the compressor shell, with the crank chamber within the compressor shell are provided at the upper portion and lower portion of the suction chamber of said valve plate.

More specifically, according to one preferred embodiment of the present invention, there is provided a compressor of a movable slanting plate type, which includes a shaft to be rotated by receiving an external driving force, a rotor having a plurality of cylinder chambers disposed in a parallel relation with the shaft so as to be rotated together with said shaft, a plurality of pistons which revolve while reciprocating within each of said cylinder chambers, a plurality of rods each connected at its one end to each of said pistons, and having a ball joint at its other end, a plurality of holder shoes each connected to said rod through said ball joint for free directivity, a movable slanting plate revolvingly supporting said holder shoes, and capable of changing its inclination angle to one direction with respect to said shaft a valve plate provided with a plurality of suction ports and delivery ports communicated with the cylinder chambers of said rotor, and a guide plate fixed to said shaft or said rotor and formed with guide bores for slidably guiding the plurality of said rods in the axial direction.

By the above arrangement according to the movable slanting plate type compressor of the present invention, advantages as follows may be obtained.

(1) A simple construction may be provided in which driving force is applied to the rod through the guide bore formed in the guide plate, while positioning for the reciprocation of the piston is readily effected.

(2) By separating the spaces behind the pistons of the respective cylinder chambers from the crank chamber by the guide plate, the inclination angle of the movable slanting plate may be altered through pressure control in the small space, and therefore, response characteristics and stability of control can be improved.

(3) The simple construction may also be achieved in which the movable slanting plate can be positioned for variable inclination only in one direction merely by the positioning pins and the guide grooves provided on said movable slanting plate and on the outer wall of the boss portion of the front cover, respectively.

(4) Since no suction valve is present, and leakage from the cylinder chamber to the crank chamber is small, with a very small compressed residual cooling medium gas volume, an efficient compressor having a high volumetric efficiency can be provided.

(5) Since holder shoes each imparted with rotational driving by the rod through the non-directional ball joint are positioned for restriction by both sides supported in the axial direction, such holder shoes are stablly slid in an elliptical path according to the inclination angle of the movable slanting plate, and it becomes possible for the piston to smoothly reciprocate within the cylinder chamber.

(6) Although the arcuate elongated opening is provided on the slanting plate as one of the positioning mechanisms for the inclination angle of the movable slanting plate caused to slide by applying a large force onto the positioning pin provided on the front cover, owing to the fact that it is disposed at the lower portion of the crank chamber where the lubricating oil is collected, good lubrication is available to improve the durability at the arcuate elongated opening sliding portion.

(7) Although the arcuate elongated opening formed in the movable slanting plate varies the inclination angle of said slanting plate by receiving a large force, if the positioning guide which guides the elongated opening through face contact, is adopted, surface pressure may be reduced to improve the durability of the arcuate elongated opening sliding portion.

(8) By constituting the sealing portion in which the clearance between the portion around the suction-/exhaust port at the end face of the rotating rotor and the valve plate is made very small, leakage of the compressed cooling medium gas into the crank chamber may be reduced, while clearances other than that of the sealing portion are adapted to be comparatively large to decrease sliding friction loss. Moreover, by introducing part of the discharged cooling medium gas inside through said sealing portion, thrust force is lowered for the improvement of durability of the thrust bearing.

(9) By disposing the sealing member at the outer peripheral side of the suction/exhaust port formed in the end face at the valve plate side of the rotor which rotates through a clearance with respect to said valve plate, leakage amount of the compressed cooling medium gas can be reduced to a large extent, with simultaneous expansion of the clearance between the rotor and the valve plate for reduction of the sliding friction loss.

(10) The lubricating oil collected in the crank chamber is introduced into the inner wall of the boss portion extending outwardly from the front cover so as to supply the lubricating oil to the bearing portion of the rotary members through pumping action of the pumping portion formed between the inner wall of said boss portion and the shaft, thereby to improve lubrication at the bearing portions for higher durability.

(11) The suction chamber formed in the rear cover and the crank chamber in the compressor shell are communicated with each other through communicating passages provided at the upper and lower portions of the suction chamber of the valve plate, and the lubricating oil or liquid cooling medium collected in said suction chamber is caused to flow out into the crank chamber through the communicating passage at the lower portion of the valve plate so as to eliminate entry thereof into the cylinder chamber for prevention of generation of abnormal pressure such as liquid compression, etc., while the cooling medium gas is circulated through the communicating passages on the valve plate for balancing pressure in the crank chamber and the suction chamber, thereby to eliminate pressure rise in the crank chamber, and achieve better lubrication for the improvement of durability and functioning of the members.

BRIEF DESCRIPTION OF THE DRAWINGS

These and other objects and features of the present invention will become apparent from the following description of a embodiment thereof taken with reference to the accompanying drawings, in which.

DETAILED DESCRIPTION OF THE INVENTION

Figure 1:
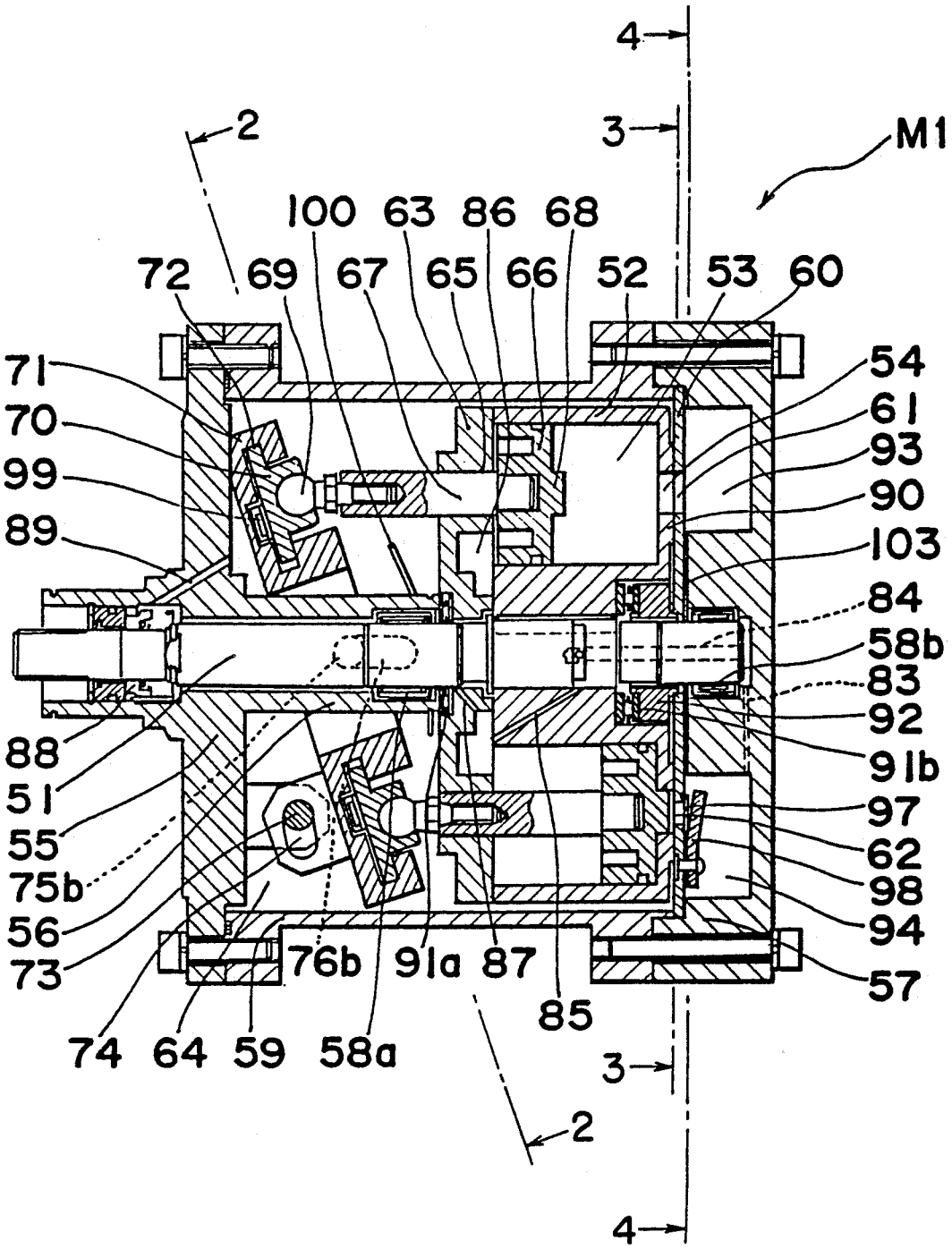
FIG. 1 is a side sectional view of a movable slanting plate type compressor according to a first embodiment of the present invention.
Figure 2:
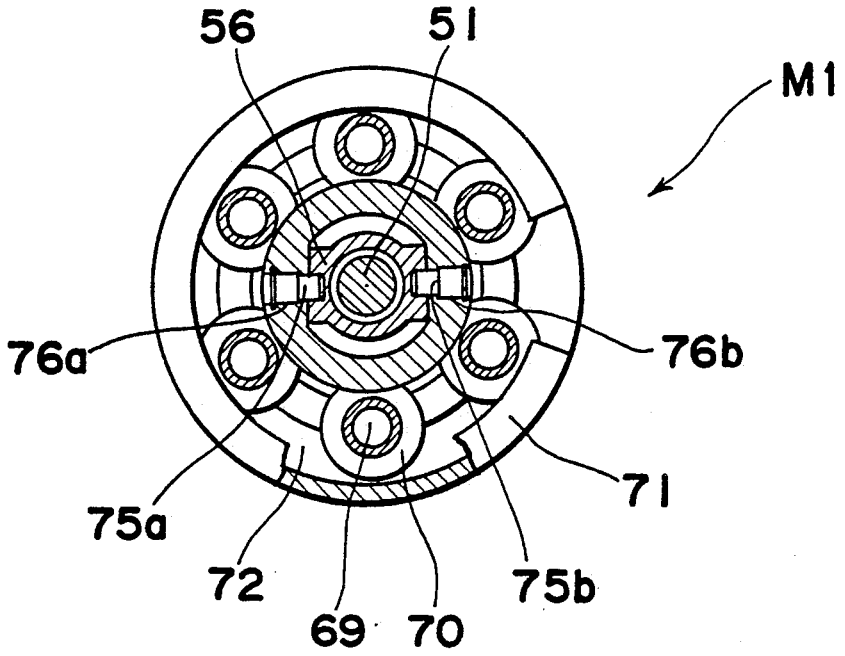
FIG. 2 is a fragmentary cross section taken along the line 2—2 in FIG. 1.

Before the description of the present invention proceeds, it is to be noted that like parts are designated by like reference numerals throughout the accompanying drawings.

Referring now to the drawings, there is shown in FIGS. 1 to 4, a movable slanting plate type compressor M1 according to one preferred embodiment of the present invention, which generally includes a shaft 51 to be rotated by receiving an external driving force, and a rotor 52 connected to said shaft, which are disposed in a compressor shell 59 closed, at its opposite end faces, by a front cover 55 and a rear cover 57.

The rotor 52 has a plurality of cylindrical cylinder chambers 53 arranged in parallel relation with respect to the shaft 51, and each formed with a suction/exhaust port 54 having a diameter smaller than that of the cylinder. The shaft 51 is supported, by radial bearings 58-*a* and 58-*b* provided on a boss portion 56 extending outwardly towards the rotor 52 from the front cover 55, and the rear cover 57. A valve plate 60 fixed to the rear cover 57 is formed with a plurality of suction ports 61 and a plurality of discharge ports 62. The end face of the rotor 52 at the side of the front cover 55 is closed by a guide plate 63 so as to be separated from a crank chamber 62. The guide plate 63 has guide bores 65 each coaxial with the cylinder chamber 53, and having a diameter smaller than that of said cylinder chamber. In each of the guide bores 65, a rod 67 connected to a piston 66 which reciprocates within the cylinder chamber 53 in the axial direction of the shaft 51 is slidably inserted. On the piston head at the side opposite to the rod 67, a protrusion 68 capable of entering the suction-/exhaust port 54 is provided. At the other end of each rod 67, there is provided a ball joint 69, to which a holder shoe 70 is coupled for free inclination to any angle. Each of the holder shoes 70 is arranged to slide during revolution within a guide support guide 72 as the shaft 51 rotates, while being positionally restricted at its opposite ends in the axial direction by said groove 72 provided in the movable slanting plate 71. It is to be noted here that the guide support groove 72 is partly cut off at the outer peripheral edge at the side of the rod 67 in an angular section corresponding to the compressor stroke, and although the slanting plate 71 is not rotated together with the shaft 51, it may be changed in its inclination angle with respect to the shaft 51 only in one direction. Subsequently, a method of positioning thereof will be described. One end of the movable slanting plate 71 is restricted by a positioning pin 73 provided at the lower portion of the front cover 55, with an arcuate elongated opening 74 of the slanting plate 71 being guided thereby. Meanwhile, at the other portion, pins 75-*a* and 75-*b* coaxially provided at the side portion of the slanting plate 71 in parallel relation with the positioning pin 73 are adapted to slide within guide grooves 76-*a* and 76-*b* formed in the side wall of the boss portion 56 for the front cover 55. The configurations of the arcuate elongated opening 74 and guide grooves 76-*a* and 76-*b* are based on the arrangement that the uppermost dead center position of the piston 66 is not varied even if the inclination angle of the movable slanting plate 71 is altered, while the center of a plane formed by connecting centers of the ball joint 69 is located on the axis of the shaft 51 at all times.

Moreover, a pressure control valve 77 (FIG. 4) provided on the rear cover 57, includes a pressure detecting portion 78 capable of generating displacement proportional to a difference between the suction pressure and atmospheric pressure, a valve rod 80 which can transmit said displacement to impart a lift to a valve 79, and a spring 81 urging the valve 79, in the lift suppressing direction, thereby to control the amount of a high pressure cooling medium gas flowing out from a high pressure introduction passage 82. The cooling medium gas flowing out from the pressure control valve 77 passes through a supply pressure passage 83, and is introduced into a pressure control chamber 86 communicated with the space at the back of the piston 66 through a passage 84 formed in the shaft 51 and a communicating passage 85 formed in the rotor 52. From said pressure control chamber 86, it passes through a flow-out port 87 for lubricating the radial bearing 58-*a* and also, a mechanical seal 88 so as to be returned to the crank chamber 64 through a port 89 formed in the front cover 55.

A clearance between the portion around the suction-/exhaust port 54 on the side face of the rotating rotor 52 at the side of the valve plate 60 and said valve plate, is set to be very small to constitute a sealing portion 90 for alleviating leakage of the compressed cooling medium gas flowing out from said port 54, while clearances at portions other than the sealing portion 90 are adapted to be comparatively large.

The very small clearance between said rotor 52 and the sealing portion 90 of the valve plate 60 is set by the boss portion 56 of the front cover 55 and the valve plate 60 through a thrust spacer 92 by thrust bearings 91-*a* and 91-*b* for positioning of the rotor 52 rotated by the shaft 51 and the guide plate 63. Meanwhile, on the inner side beyond the sealing portion 90 and the thrust bearing 91-*b*, the high pressure cooling medium gas flowing out from the pressure control valve 77 is introduced through the radial bearing 58-*b*.

The valve plate 60 at the side of the rear cover 57 has a suction port 61 and a discharge port 62 opening out of a suction chamber 93 and a discharge chamber 94 in the rear cover 57 respectively. At the upper portion in the suction chamber 93 of the valve plate 60, a gas balancing port 95 is formed, while at the lower portion of the suction chamber 93 of said valve plate 60, an oil flow-out port 96 is provided so as to communicate the suction chamber 93 with the crank chamber 64. There are further provided a discharge valve 97, a discharge valve presser plate 98, a thrust bearing 99 provided on the slanting discharge port 102, and a packing 103, etc.

Hereinafter, functioning of the movable slanting plate compressor is explained.

Upon driving of the shaft 51, the rotor 52 and the guide plate 63 are rotated as one unit therewith, while the driving force is applied to the rods 67 through the guide bores 65, and each of the holder shoes 70 coupled with the rods 67 via the ball joints 69 for free directivity is positioned for restriction at its opposite ends in the axial direction by the guide support groove 72 of the inclined slanting plate 71 for stable revolution and sliding, while drawing an elliptic path according to the inclination of the slanting plate 71. Thus, the pistons 66 connected to the other ends of the rods 67 effect a smooth reciprocating movement within the cylinder chambers 53 in the direction of the shaft 51.

The cooling medium gas which has entered the suction chamber 93 of the rear cover 57, is drawn into the respective cylinder chambers 53 through the suction-/exhaust ports 54 of the rotor 52 communicated with the suction port 61 of the valve plate 60 in the suction stroke in which the piston 66 is displaced from the uppermost dead center to the lower dead center, and during the compression and discharge stroke in which the piston 66 moves form the lower dead center to the uppermost dead center, the cooling medium gas is compressed to a high pressure, and flows out into the discharge chamber 94 by pushing open the discharge valve 97 and flowing through the discharge port 62 communicated with the suction/exhaust port 54.

For the performance control, it is arranged to non-stepwisely vary the physical displacement or exhaust amount, i.e. the volume of the cylinder 53, by altering the stroke of the piston 66 from the uppermost dead center to the lower dead center through variation of the inclination angle of the movable slanting plate 71. The inclination angle of the slanting plate 71 is determined by the pressure of the pressure control chamber 86 communicated with the rear space of the piston 66 and the acting force produced on the piston 66. The pressure control for the pressure control chamber 86 is effected by the pressure control valve 77 which detects the suction pressure, and when the suction pressure falls below the set pressure of the pressure control valve 77 due to lowering of the thermal load, the valve 77 causes the high pressure cooling medium gas to flow out so as to be introduced into the pressure control chamber 86, thereby to control the pressure within the pressure control chamber 86 for variation of the inclination angle of the slanting plate 71. In this case, since the pressure control chamber 86 is a small space independent from the crank chamber 64, it has superior response characteristics with respect to the pressure control, and thus, it becomes possible to alter the inclination angle of the slanting plate 71 instantaneously for the improvement of stability for control.

Meanwhile, the positioning at the inclination angle of the movable slanting plate 71 is effected by the two positioning mechanisms, i.e. the combination of the positioning pin 73 provided on the front cover 55 and the arcuate elongated opening 74 formed in the slanting plate 71, and the combination of the guide grooves 76-*a* and 76-*b* formed in the boss portion 56 of the front cover 55, and the set of the pins 75-*a* and 75-*b* engaging therewith, while, by the arrangement that the central portion of the movable slanting plate 71 is guided by the outer wall of the boss portion 56 of the front cover 55, the slanting plate 71 may be changed in its inclination angle only in the direction of the shaft axis, with the position of the uppermost dead center of the piston 66 being set to be constant.

With respect to the efficiency, since the arrangement has no suction valve, there is no resistance when the cooling medium gas flows into the cylinder chamber 53, with a consequent reduction of loss during suction. Meanwhile, since the convex portion 68 capable of entering the suction/exhaust port 54 is formed on the head of the piston 66, the compressed residual cooling medium gas is very small in volume.

Figure 5A:
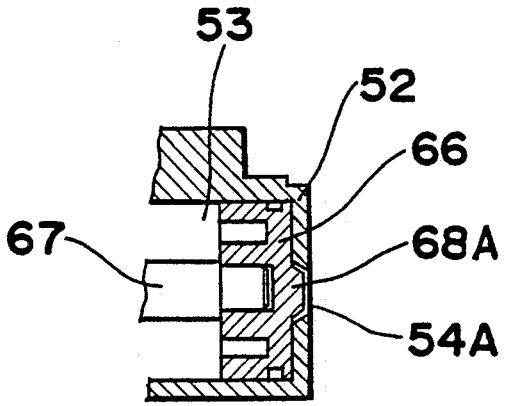
Figure 5B:
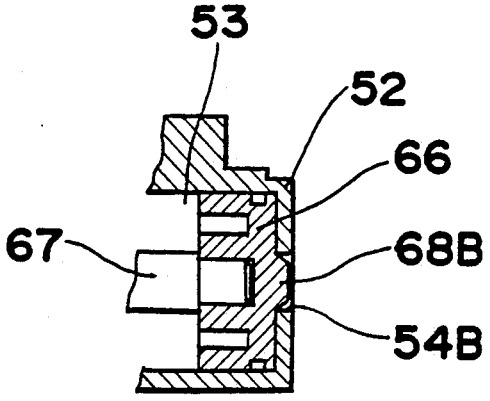

In FIGS. 5(*a*) and 5(*b*), there are shown modifications of the construction of the convex portion 68 of the piston 66 and the suction/exhaust port 54 referred to above.

In the modification of FIG. 5(*a*), both of the convex portion 68A of the piston 66 and the suction/exhaust port 54A are formed into tapered cross sections so as to have smaller diameters in the direction to reduce the piston stroke.

In another modification of FIG. 5(*b*), only the convex portion 68B of the piston 66 is formed into a tapered cross section, and the suction/exhaust port 54B has a straight cross section without tapering.

In both of the above modifications, the compressed residual cooling medium gas volume is reduced, and the resistance of the compressed cooling medium gas flowing out into the port 54 is reduced when the piston 66 approaches the uppermost dead center.

Furthermore, according to the first embodiment of the present invention as described so far, by providing a sealing portion 90 in which the portion around the suction/exhaust port 54 and the valve plate 60 is made very small, the leakage amount of the compressed cooling medium gas from the cylinder chamber 53 to the crank chamber 64 is reduced, while at portions other than the sealing portion 90, since the rotor 52 rotates at a comparatively large clearance with respect to the valve plate 60, sliding loss is reduced, with a high volumetric efficiency, and thus, a highly efficient compressor has been provided.

Hereinafter, durability of the compressor according to the present invention will be described.

Although the rotor 52 and the guide plate 63 which rotate as one unit are positioned by the thrust spacer 92 and thrust bearings 91-*a* and 91-*b* for setting the clearance with respect to the valve plate 60, thrust force acts towards the side of the valve plate 60 by the compression force of the cooling medium gas, and the thrust bearing at said side is subjected to a large force. Therefore, by introducing part of the discharged cooling medium gas into the inner side beyond the sealing portion 90 between the rotor 52 and the valve plate 60, the thrust force is reduced to improve durability of the thrust bearing. Meanwhile, the arcuate elongated opening 74 as a positioning point for the inclination angle of the slanting plate 71 is slid as it is guided by the positioning pin 73 provided on the front cover 55, while being subjected to a large force, but owing to the arrangement that the opening 74 and the pin 73 are disposed at the lower portion of the crank chamber 64, they are fully lubricated, thus improving durability for the sliding portion of the arcuate elongated opening 74.

Figure 3:
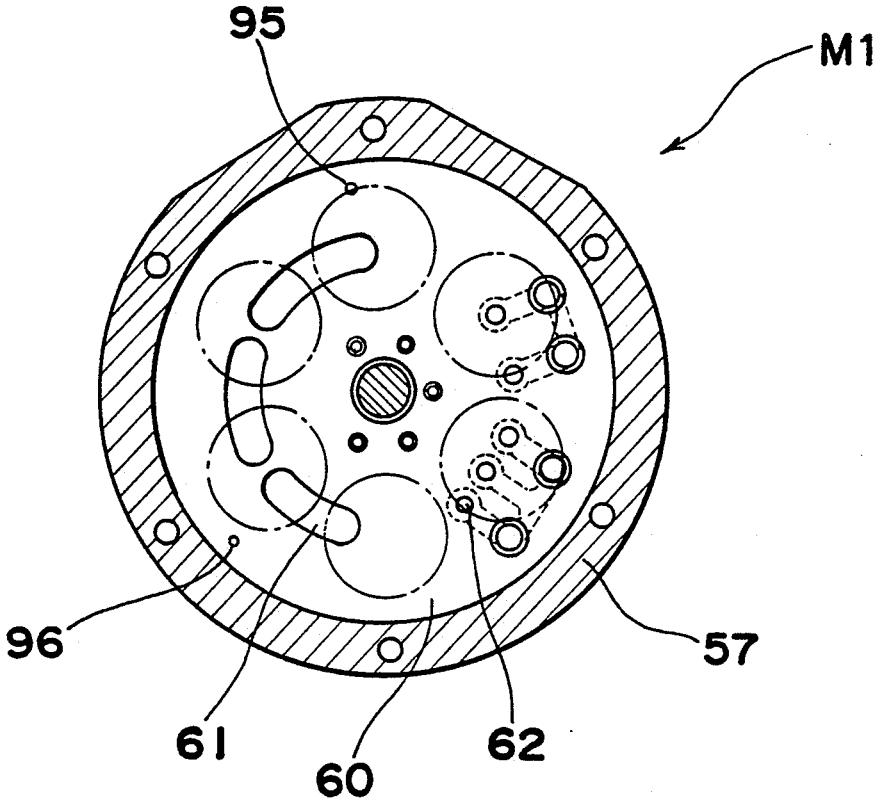
FIG. 3 is a fragmentary cross section taken along the line 3—3 in FIG. 1.
Figure 4:
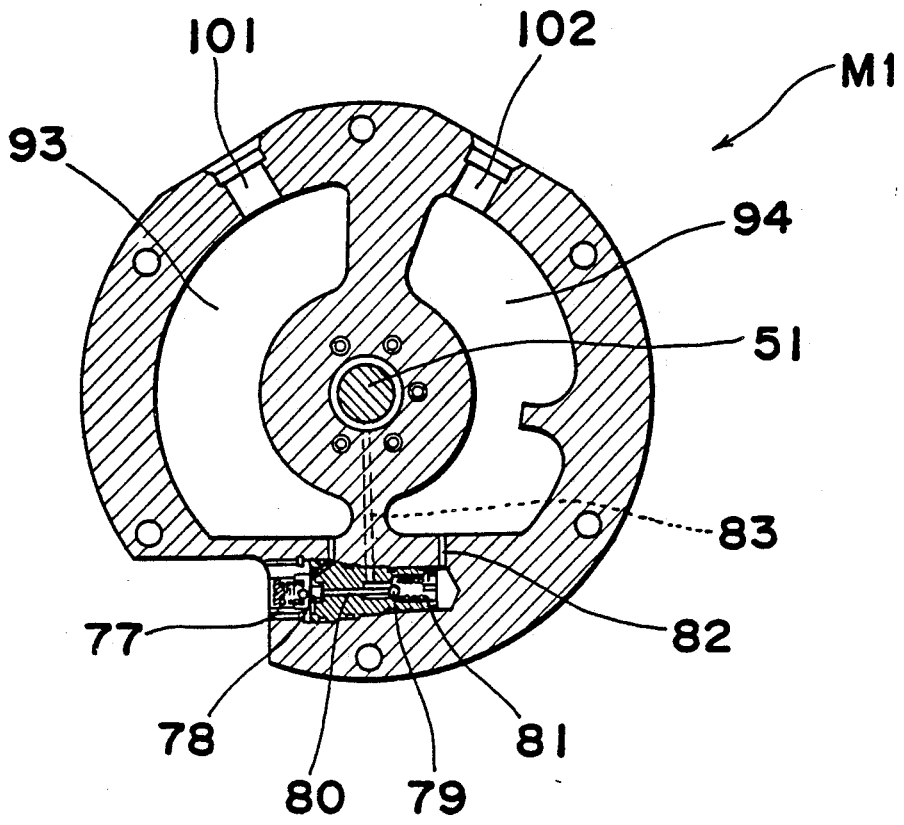
FIG. 4 is a fragmentary cross section taken along the line 4—4 in FIG. 1, FIGS. 5(*a*) and 5(*b*) are fragmentary cross sections showing modifications of the piston and suction/exhaust port arrangement, FIG. 6(*a*) is a fragmentary cross section at an arcuate elongated opening for positioning the inclination angle of a movable slanting plate for a compressor M2 according to a second embodiment of the prsents invention, FIG. 6(*b*) is a fragmentary cross section taken along the line 6*b*—6*b* in FIG. 6(*a*)

Furthermore, since lubricating oil and liquid cooling medium may enter the suction chamber 94 of the rear cover 57 in some cases and flow into the cylinder chamber 53 from the suction port 61 through the suction/exhaust port 54 of the rotor 52 to produce abnormal pressure upon compression, thereby resulting in a possibility to break various members, the oil flow-out port 96 is formed at the lower portion of the suction chamber 94 of the valve plate 60 so as to communicate the suction chamber 94 with the crank chamber 64, while, at the upper portion of the suction chamber 94 of the valve plate 60, the gas balancing port 95 is formed to communicate the suction chamber 94 with the crank chamber 64 for balancing of the pressure so as to prevent the pressure rise in the crank chamber 64 (FIG. 3). Meanwhile, by the gas balancing port 95 and the oil flow-out port 96, the state of lubrication is also improved.

Moreover, since the amount of unbalancing of the rotary members resulting from vibrations is small, and no suction valve which may give rise to noises is required, it is possible to obtain a compressor which will to reduce vibrations and noises.

Figure 6A:
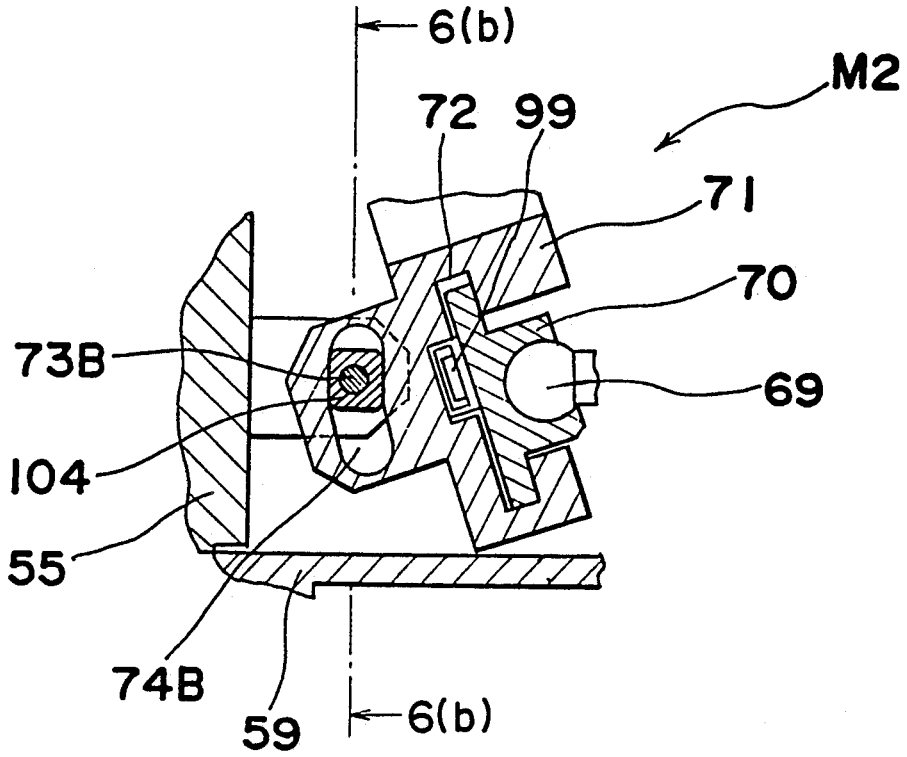
Figure 6B:
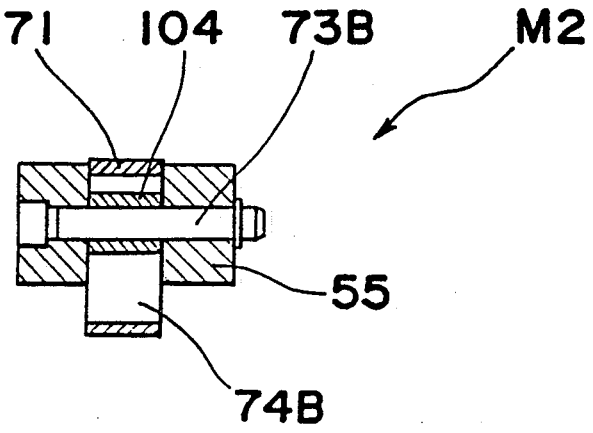

Referring further to FIGS. 6(*a*) and 6(*b*), there is shown a movable slanting plate type compressor M2 according to a second embodiment of the present invention. FIG. 6(*a*) is a fragmentary cross section at the arcuate elongated opening 74 for determining the inclination angle of the movable slanting plate 71, and FIG. 6(*b*) is also a fragmentary cross section taken along the line 6*b*—6*b* in FIG. 6(*a*). It is to be noted here that FIGS. 6(*a*) and 6(*b*) show only portions of a compressor of the second embodiment, different from those in the first embodiment of FIGS. 1 to 5, with like parts being designated by like reference numerals.

In FIGS. 6(*a*) and 6(*b*), there is provided a positioning guide 104 rotatably connected to the positioning pin 73B fixed to the front cover 55 and having a configuration for face contact at a guide face of the arcuate elongated opening 74B formed in the slanting plate 71 so as to guide the elongated opening 74B for positioning of the inclination angle of the slanting plate 71. This positioning guide 104 may be modified to be fixed to the positioning pin 73B, but in this case, the positioning pin 73B should be rotatably supported on the front cover 55.

In the above arrangement of FIGS. 6(*a*) and 6(*b*), although the arcuate elongated opening 74B acting as a fulcrum for positioning when the inclination angle of the movable slanting plate 71 is varied, is slid as it is guided by the positioning guide 104, while being subjected to a large force, since the opening 74B and positioning guide 104 are slid through face contact, bearing pressure of the acting force is reduced to improve the durability of the arcuate elongated opening 74B.

Figure 7:
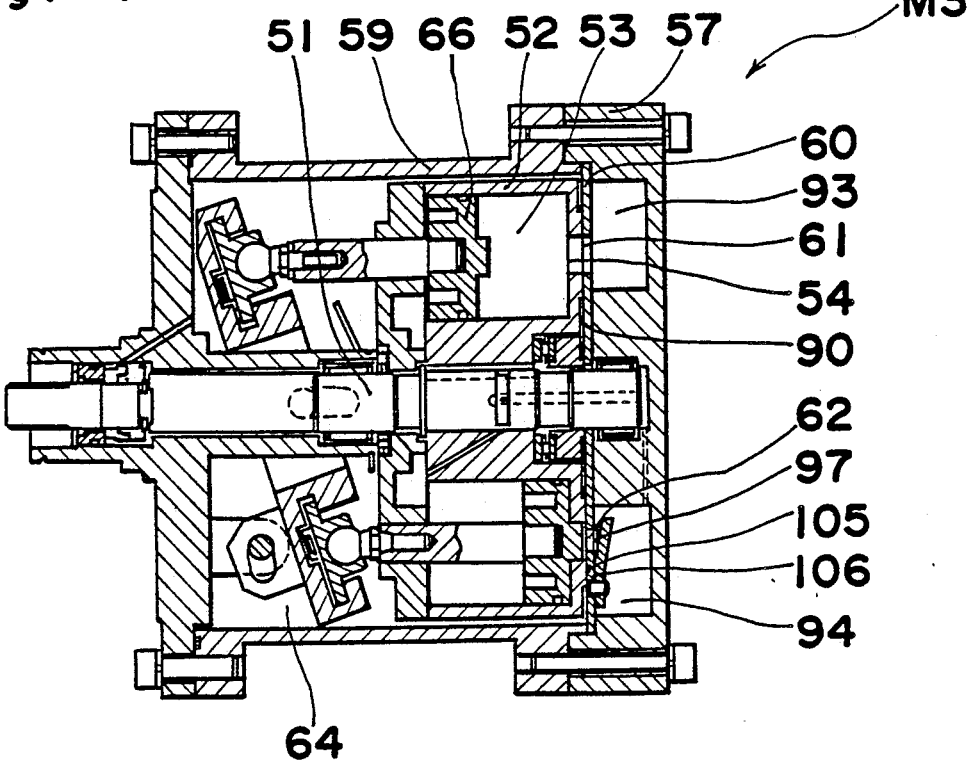
FIG. 7 is a side sectional view of a movable slanting plate compressor according to a third embodiment of the present invention.

Referring further to FIG. 7, there is shown a movable slanting plate type compressor M3 according to a third embodiment of the present invention.

With respect to FIG. 7, only the portions different form those in FIGS. 1 to 4 will be explained, with like parts being designated by like reference numerals for brevity of description.

In FIG. 7, there is further included a sealing member 105 disposed at the sealing portion 90 which is the very small clearance around the suction/exhaust port 54 provided at the valve plate side end face of the rotor 52 rotating through a clearance with respect to the valve plate 60. The sealing member 105 is inserted in a sealing groove 106 formed in the valve plate 60 in a position outside the suction port 61 and discharge port 62 and confronting the sealing portion 90.

In the above arrangement of FIG. 7, although the cooling medium gas within the cylinder chamber 53 is compressed by the piston 66 to push open the discharge valve 97 through the discharge port 62 from the suction/exhaust port 54 for flowing out into the discharge chamber 94, the sealing member 105 disposed at the sealing portion 90 prevents part of the compressed cooling medium gas from leaking into the crank chamber 64 through the clearance between the rotor 52 and the valve plate 60. The leakage prevention effect in the above arrangement is improved to a large extent as compared with the case where only the sealing portion 90 which is the very small clearance around the suction/exhaust port 54, is provided, and not only a high volumetric efficiency is obtained, but the sliding friction loss is alleviated, since the clearance between the rotating rotor 52 and the valve plate 60 can be enlarged for the improvement of the compressor efficiency.

Figure 8:
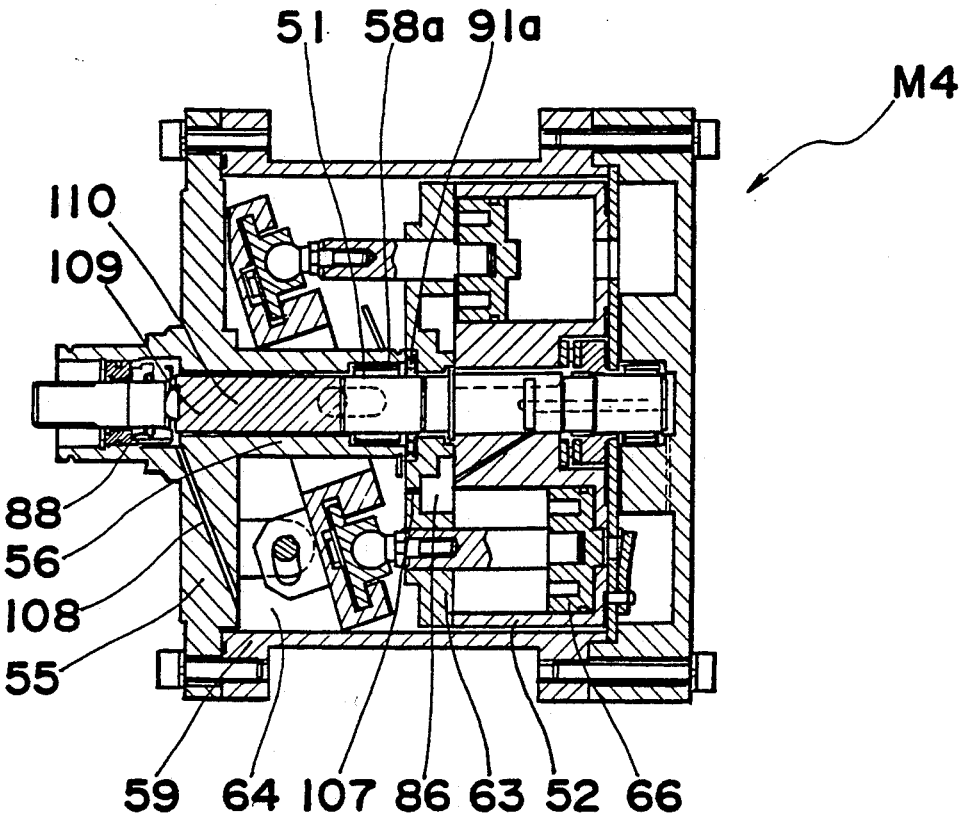
FIG. 8 is a view similar to FIG. 7, which particularly shows a movable slanting plate type compressor M4 according to a fourth embodiment thereof.
Figure 9:
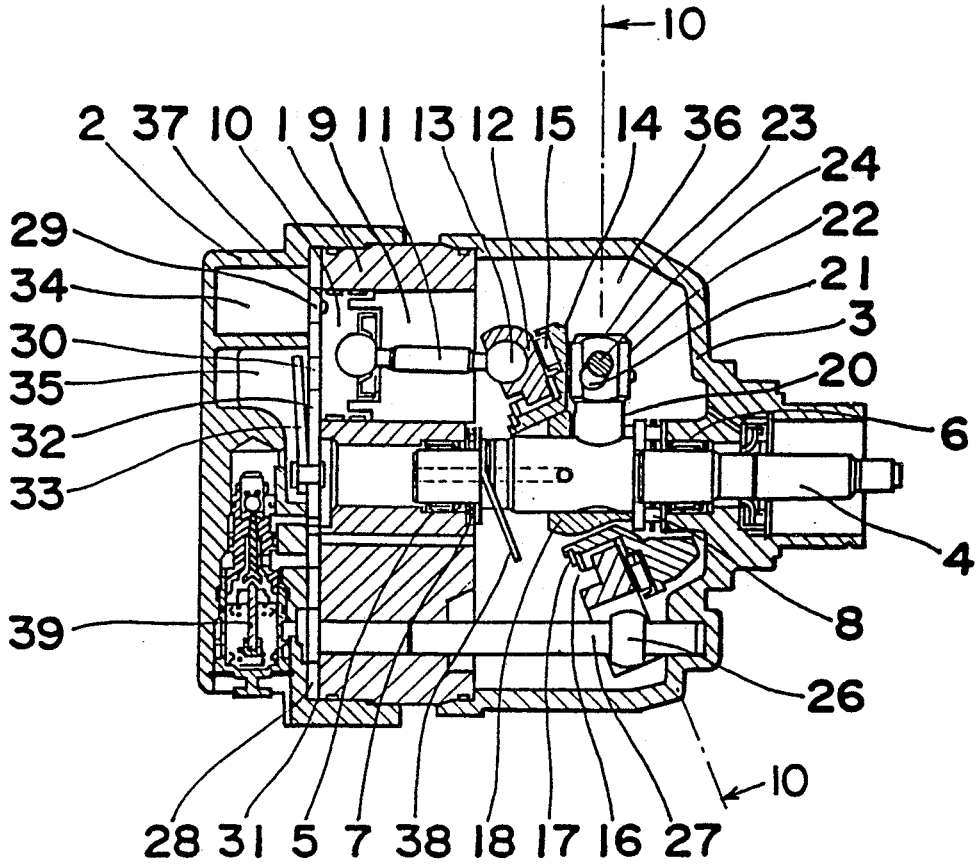
Fig. 9 PRIOR ART
FIG. 9 is a side sectional view of a conventional movable slanting plate type compressor.
Figure 10:
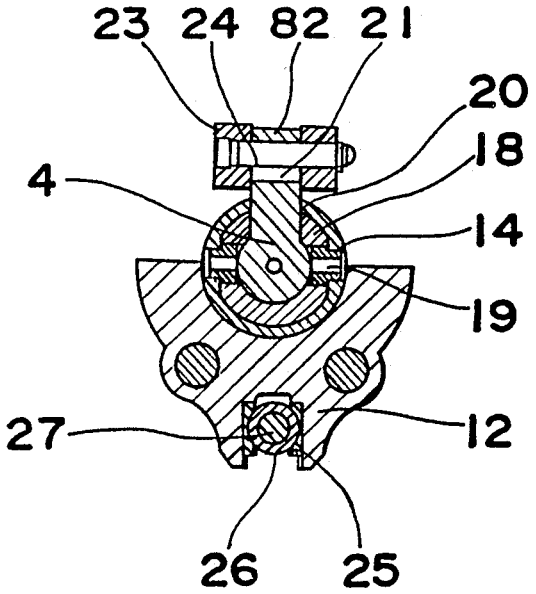
Fig. 10 PRIOR ART
FIG. 10 is a fragmentary cross section taken along the line 10—10 in FIG. 9.

Referring further to FIG. 8, there is shown a movable slanting plate type compressor M4 according to a fourth embodiment of the present invention.

With respect to FIG. 8 also, only the portions different form those in FIGS. 1 to 4 will be explained, with like parts being designated by like reference numerals for brevity of explanation.

In FIG. 8, there are further provided a flow-out port 107 formed in the guide plate 63 for communicating the pressure control chamber 86 with the crank chamber 64, a through-hole 108 for communicating the lower portion of the crank chamber 64 and the interior of the boss portion 56 of the front cover 55, and a pump portion 109 including grooves 110 formed at the portion of the shaft 51 in the boss portion 56.

In the above arrangement of FIG. 8, at the lower portion of the crank chamber 64 within the compressor shell 59, the lubricating oil is collected so as to be supplied into the inner wall of the boss portion 56 extending outwardly from the front cover 55 by said through-hole 108. The lubricating oil thus fed lubricates the mechanical seal 88, and is simultaneously supplied to the radial bearing 58-*a* and the thrust bearing 91-*a* for supporting the shaft 51, the rotor 52, and the guide plate 63 which rotate as one unit for improved lubrication and durability of the bearing portions for the rotary members.

Although the present invention has been fully described by way of example with reference to the accompanying drawings, it is to be noted here that various changes and modifications will be apparent to those skilled in the art. Therefore, unless otherside such changes and modifications depart from the scope of the present invention, they should be construed as included therein.

What is claimed is:

1. A compressor of a movable slanting plate type, which comprises:

a shaft to be rotated by receiving an external driving force;

a rotor having a plurality of cylinder chambers disposed in parallel relation with said shaft for rotation together with said shaft and a plurality of pistons which reciprocate within said cylinder chambers and revolve around said shaft;

a plurality of rods each having one end connected to a corresponding piston and having a ball joint at the other end;

a plurality of holder shoes, one connected to each of said rods through the corresponding ball joint for free directivity;

a movable slanting plate revolvingly supporting said holder shoes and movable for having the angle of inclination thereof changed in one direction with respect to said shaft;

a valve plate having a plurality of suction/discharge ports communicated with said cylinder chambers of said rotor;

a guide plate fixed to one of said shaft and said rotor and having guide bores therein for slidably guiding said plurality of rods in the axial direction parallel to said shaft, said guide plate being close to an end face of said rotor and being provided with groove means communicating with the portions of said cylinder chambers between said guide plate and said pistons, said groove means and said portions of said cylinder chambers forming a pressure control chamber; and means for controlling pressure in said pressure control chamber for controlling the angle of inclination of said movable slanting plate.

2. A compressor of a movable slanting plate type, which comprises:

a shaft to be rotated by receiving an external driving force;

a rotor having a plurality of cylinder chambers disposed in parallel relation with said shaft for rotation together with said shaft and a plurality of pistons which reciprocate within said cylinder chambers and revolve around said shaft;

a plurality of rods each having one end connected to a corresponding piston and having a ball joint at the other end;

a plurality of holder shoes, one connected to each of said rods through the corresponding ball joint for free directivity;

a movable slanting plate revolvingly supporting said holder shoes and movable for having the angle of inclination thereof changed in one direction with respect to said shaft;

a valve plate having a plurality of suction/discharge ports communicated with said cylinder chambers of said rotor;

a guide plate fixed to one of said shaft and said rotor and having guide bores therein for slidably guiding said plurality of rods in the axial direction parallel to said shaft;

the end face of said rotor at said valve plate being spaced by only a very small clearance with respect to said valve plate around said suction/discharge ports, and a comparatively large clearance being provided between said rotor and valve plate at locations other than around said suction/exhaust ports; and means for introducing discharged cooling medium gas into said relatively large clearance radially outwardly of said small clearance.

3. A compressor as claimed in claim 2, further comprising a sealing member disposed around the outer periphery of each of said suction discharge ports for sealing the space between said rotor and said valve plate.

4. A compressor of a movable slanting plate type, which comprises:

a shaft to be rotated by receiving an external driving force;

a rotor having a plurality of cylinder chambers disposed in parallel relation with said shaft for rotation together with said shaft and a plurality of pistons which reciprocate within said cylinder chambers and revolve around said shaft;

a plurality of rods each having one end connected to a corresponding piston and having a ball joint at the other end;

a plurality of holder shoes, one connected to each of said rods through the corresponding ball joint for free directivity;

a movable slanting plate revolvingly supporting said holder shoes and movable for having the angle of inclination thereof changed in one direction with respect to said shaft;

a valve plate having a plurality of suction/discharge ports communicated with said cylinder chambers of said rotor;

a guide plate fixed to one of said shaft and said rotor and having guide bores therein for slidably guiding said plurality of rods in the axial direction parallel to said shaft;

said compressor further comprising a compressor housing in which said shaft, rotor, pistons, rods, slanting plate and guide plate are mounted, said housing defining a crank chamber, said housing having a front cover having a boss thereon projecting into said crank chamber and having a hollow bore therethrough in which said shaft is rotatably supported, the lower portion of said crank chamber and said hollow bore being communicated with each other, and a pump means being provided between said hollow bore and the portion of said shaft rotating in said hollow bore for supplying lubricating oil from said crank chamber to said hollow bore.

5. A compressor of a movable slanting plate type, which comprises:

a shaft to be rotated by receiving an external driving force;

a rotor having a plurality of cylinder chambers disposed in parallel relation with said shaft for rotation together with said shaft and a plurality of pistons which reciprocate within said cylinder chambers and revolve around said shaft;

a plurality of rods each having one end connected to a corresponding piston and having a ball joint at the other end;

a plurality of holder shoes, one connected to each of said rods through the corresponding ball joint for free directivity;

a movable slanting plate revolvingly supporting said holder shoes and movable for having the angle of inclination thereof changed in one direction with respect to said shaft;

a valve plate having a plurality of suction/discharge ports communicated with said cylinder chambers of said rotor;

a guide plate fixed to one of said shaft and said rotor and having guide bores therein for slidably guiding said plurality of rods in the axial direction parallel to said shaft;

said compressor further comprising a compressor housing in which said shaft, rotor, pistons, rods, slanting plate and guide plate are mounted, said housing defining a crank chamber, said housing having a rear cover having a suction chamber therein and said valve plate having passages therethrough at the upper and lower portion of said suction chamber communicating said suction chamber with said crank chanber.

* * * * *